US010919310B1

(12) United States Patent
Schweid et al.

(10) Patent No.: US 10,919,310 B1
(45) Date of Patent: Feb. 16, 2021

(54) METHODS FOR OPERATING PRINTHEAD INKJETS TO ATTENUATE INK DRYING IN THE INKJETS DURING PRINTING OPERATIONS

(71) Applicant: Xerox Corporation, Norwalk, CT (US)

(72) Inventors: Stuart A. Schweid, Pittsford, NY (US); Raymond J. Clark, Webster, NY (US); David J. Metcalfe, Marion, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 16/704,370

(22) Filed: Dec. 5, 2019

(51) Int. Cl.

| | |
|---|---|
| ***B41J 2/21*** | (2006.01) |
| ***B41J 29/393*** | (2006.01) |
| ***B41J 2/01*** | (2006.01) |
| ***B41J 2/36*** | (2006.01) |

(52) U.S. Cl.
CPC ..... *B41J 2/2103* (2013.01); *B41J 2/01* (2013.01); *B41J 2/36* (2013.01); *B41J 29/393* (2013.01)

(58) Field of Classification Search
CPC ..... B41J 2/01; B41J 2/2103; B41J 2/36; B41J 29/393
See application file for complete search history.

(56) References Cited

U.S. PATENT DOCUMENTS 3,938,095 A * 2/1976 Check, Jr. ..... G07C 9/33 705/402
5,343,231 A 8/1994 Suzuki
5,451,990 A 9/1995 Sorenson et al.
5,600,350 A 2/1997 Cobbs et al.
5,796,414 A 8/1998 Sievert et al.
6,076,915 A 6/2000 Gast et al.
6,089,693 A 7/2000 Drake et al.
6,196,652 B1 3/2001 Subirada et al.
6,275,600 B1 8/2001 Banker et al.
6,300,968 B1 10/2001 Kerxhalli et al.
6,334,720 B1 1/2002 Kato et al.
6,377,758 B1 4/2002 OuYang et al.
6,467,867 B1 10/2002 Worthington et al.
6,494,558 B1 12/2002 Doval et al.
6,554,390 B2 4/2003 Arquilevich et al.
6,637,853 B1 10/2003 Ahne et al.
6,847,465 B1 1/2005 Wetchler et al.
6,883,892 B2 4/2005 Sievert et al.
6,942,313 B2 9/2005 Kanda
6,993,275 B2 1/2006 Mitsuya et al.
7,073,883 B2 7/2006 Billow
7,118,188 B2 10/2006 Vilanova et al.
7,254,254 B2 8/2007 Ueda et al.
7,380,897 B2 6/2008 Anderson et al.
7,390,073 B2 6/2008 Bailey et al.
7,391,525 B2 6/2008 Chapman et al.
(Continued)

*Primary Examiner* — Anh T Vo
(74) *Attorney, Agent, or Firm* — Maginot Moore & Beck LLP

(57) ABSTRACT

A method of printer operation identifies inkjets to operate in each scanline to eject sneeze drops or, in an alternative approach, identifies the cross-process direction scanlines within a page to be printed by the printer where each inkjet ejects sneeze drops. The methods use a binary grayscale code counter that generates a sequence of binary grayscale code numbers and every other output of the sequence is bit reversed to spread the sneeze drops over the pages of the printer output so the sneeze drops are not perceptible to a human observer.

19 Claims, 6 Drawing Sheets

(56) References Cited

U.S. PATENT DOCUMENTS

| | | | | |
|---|---|---|---|---|
| 7,478,894 | B2 | 1/2009 | Kim et al. | |
| 7,515,305 | B2 | 4/2009 | Mizes | |
| 7,549,721 | B2 | 6/2009 | Nakano et al. | |
| 7,552,986 | B2 | 6/2009 | Mizes et al. | |
| 7,607,752 | B2 | 10/2009 | Childers et al. | |
| 7,630,653 | B2 | 12/2009 | Bonino | |
| 7,637,586 | B2 | 12/2009 | Yun | |
| 7,686,298 | B2 | 3/2010 | Fioravanti et al. | |
| 8,585,173 | B2 * | 11/2013 | Mizes | G06K 15/027 347/19 |
| 8,721,033 | B2 * | 5/2014 | Mongeon | B41J 3/543 347/19 |
| 2002/0135629 | A1 | 9/2002 | Sarmast et al. | |
| 2003/0231350 | A1 | 12/2003 | Yamagishi | |
| 2004/0160468 | A1 | 8/2004 | Kim et al. | |
| 2005/0099447 | A1 | 5/2005 | Hsu et al. | |
| 2009/0322849 | A1 | 12/2009 | Calamita et al. | |
| 2010/0013882 | A1 | 1/2010 | Mizes et al. | |

* cited by examiner

METHODS FOR OPERATING PRINTHEAD INKJETS TO ATTENUATE INK DRYING IN THE INKJETS DURING PRINTING OPERATIONS

TECHNICAL FIELD

This disclosure is directed to printheads that eject liquid ink to form ink images on substrates as they pass the printheads and, more particularly, to the operation of the inkjets during ink image printing to help maintain the operational status of the inkjets in the printheads.

BACKGROUND

Inkjet imaging devices eject liquid ink from printheads to form images on an image receiving surface. The printheads include a plurality of inkjets that are arranged in some type of array. Each inkjet has a thermal or piezoelectric actuator that is coupled to a printhead driver. The printhead controller generates firing signals that correspond to digital data for images. Actuators in the printheads respond to the firing signals by expanding into an ink chamber to eject ink drops onto an image receiving member and form an ink image that corresponds to the digital image used to generate the firing signals.

Inkjets, especially those in printheads that eject aqueous inks, need to regularly fire to help prevent the ink in the nozzles from drying. If the viscosity of the ink increases too much, the probability of an inkjet failure increases substantially. To maintain the inkjets, manufacturers of printheads provide specifications for a predetermined minimum rate of inkjet operation. Operating the inkjets at the predetermined inkjet rate keeps ink moving through the inkjets and helps prevent inoperative or malfunctioning inkjets. Unfortunately, printing ink images alone is insufficient to guarantee that all of the inkjets are operated at the predetermined minimum rate of inkjet operation. To address this issue, a controller operates the inkjets to eject ink drops that are not part of the ink image being formed. This non-image based inkjet operation, sometimes known as "sneezing," produces background pixels along with the ink image content on the pages produced by the printer. Dispersing these non-image ink drops in an ink image needs to be done in a manner that minimizes the observed degradation caused by sneezing while guaranteeing the predetermined minimum rate of inkjet operation is achieved. Some methods of sneezing, such as using a random number generator to determine which inkjets to operate in a given scanline of an image, can produce visible artifacts at some typical predetermined minimum rates without guaranteeing the predetermined minimum rate is obtained. Other methods, such as using halftone screens, are designed for a single given predetermined minimum rate and do not work well for other predetermined minimum rates. A more robust and effective method of operating inkjets in a printer during printing operations to achieve predetermined minimum rates of inkjet operation without visibly degrading the image quality of the ink images would be beneficial.

SUMMARY

A new method of operating inkjets in an inkjet printer during printing operations achieves predetermined minimum rates of inkjet operation without visibly degrading the image quality of the ink images. The method includes operating with a controller a binary grayscale code counter to generate a sequence of binary grayscale code numbers, the sequence having a number of binary grayscale code numbers equal to or greater than a number of inkjets in the printer and each binary grayscale code number in the sequence having a number of bits equal to or greater than $\log_2 (N-1)$, where N is a number of inkjets in the printer, and operating with the controller a predetermined number of inkjets for each scanline extending in a cross-process direction to eject sneeze drops in each scanline, the inkjets operated in each scanline being identified using a number of binary grayscale code numbers produced in the sequence of the binary grayscale code numbers that correspond to the predetermined number of inkjets and all of the inkjets in the printer are operated once to eject sneeze drops during a single sequence produced by the binary grayscale code counter.

Another new method of operating inkjets in an inkjet printer during printing operations achieves predetermined minimum rates of inkjet operation without visibly degrading the image quality of the ink images. The other new method includes operating with a controller a binary grayscale code counter to generate a sequence of binary grayscale code numbers, the sequence having a number of binary grayscale code numbers equal to or greater than a number of cross-process direction scanlines that extend in a process direction to form a page printed by a printer and each binary grayscale code number in the sequence having a number of bits equal to or greater than $\log_2 (N-1)$, where N is the number of binary grayscale code numbers generated by the binary grayscale code counter, identifying the cross-process direction scanlines within the page where each inkjet in printer ejects a sneeze, the cross-process direction scanline identifications being made using the binary grayscale code numbers generated by the binary grayscale code counter, and operating with the controller each inkjet at the identified cross-process direction scanlines within the page for each inkjet to eject sneeze drops.

BRIEF DESCRIPTION OF THE DRAWINGS

The foregoing aspects and other features of operating an inkjet printer to achieve predetermined minimum rates of inkjet operation without visibly degrading the image quality of the ink images are explained in the following description, taken in connection with the accompanying drawings.

DETAILED DESCRIPTION

Figure 1:
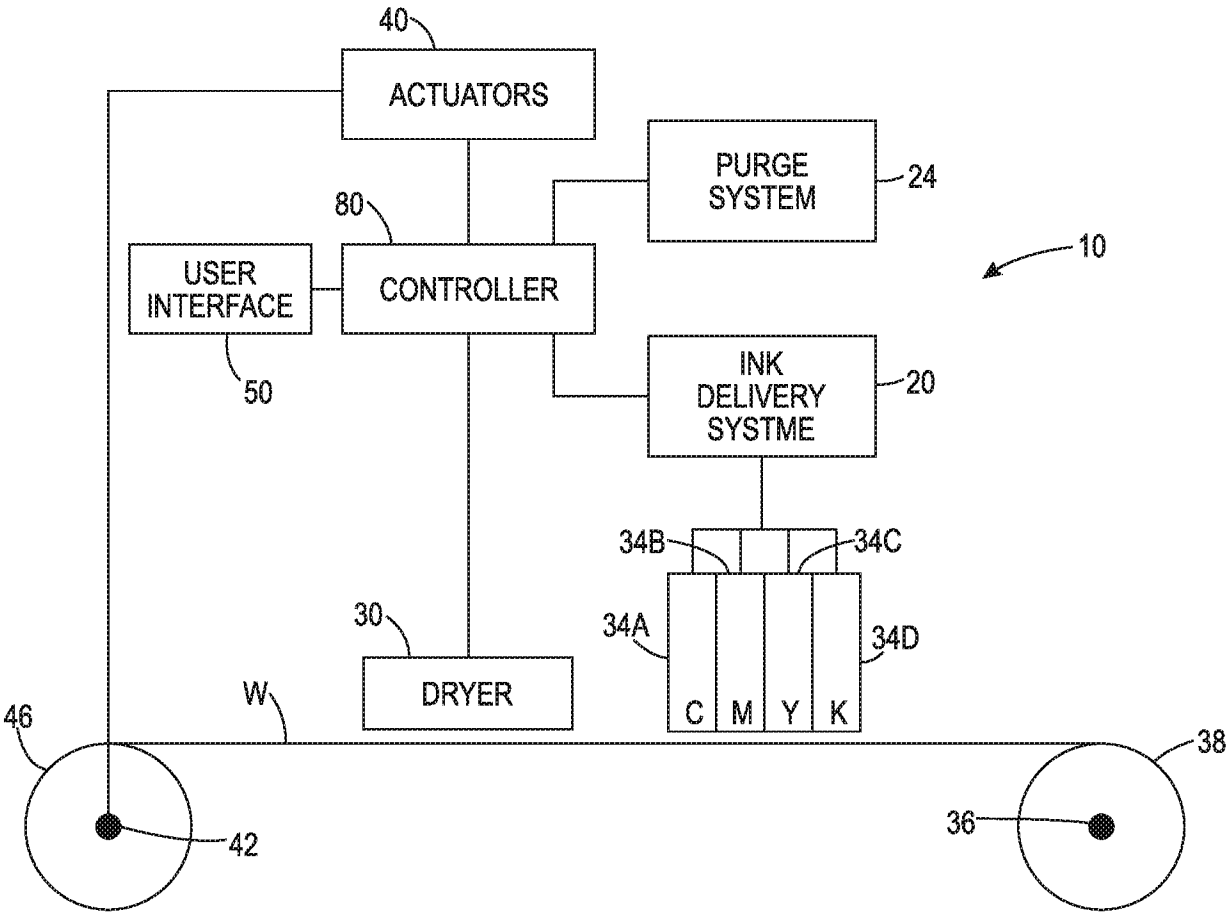
FIG. 1 depicts an inkjet printer that operates the inkjets in the printheads of the printer to achieve predetermined minimum rates of inkjet operation without visibly degrading the image quality of the ink images.

For a general understanding of the environment for the system and method disclosed herein as well as the details for the system and method, reference is made to the drawings. In the drawings, like reference numerals have been used throughout to designate like elements. As used herein, the word "printer" encompasses any apparatus that produces ink images on media, such as a digital copier, bookmaking machine, facsimile machine, a multi-function machine, or the like. As used herein, the term "process direction" refers to a direction of travel of an image receiving surface, such as an imaging drum or print media, and the term "cross-process direction" is a direction that is substantially perpendicular to the process direction along the surface of the image receiving surface. As used in this document, the term "sneeze drop" or "sneeze drop ejection" refers to non-image ink drops ejected by identified inkjets to maintain the operational status of the inkjets in the printer. Also, the description presented below is directed to a system for operating inkjets in an inkjet printer to reduce evaporation of ink at the nozzles of the inkjets in the printer. The reader should also appreciate that the principles set forth in this description are applicable to similar imaging devices that generate images with pixels of other types of marking material.

FIG. 1 illustrates a high-speed aqueous ink image producing machine or printer 10 in which a controller 80 has been configured to perform the process 400, the process 500, or both processes that are described below to operate the printheads during printing operations so the inkjets in the printheads 34A, 34B, 34C, and 34D have a higher likelihood of remaining operational. As illustrated, the printer 10 is a printer that directly forms an ink image on a surface of a web W of media pulled through the printer 10 by the controller 80 operating one of the actuators 40 that is operatively connected to the shaft 42 to rotate the shaft and the take up roll 46 mounted about the shaft. In one embodiment, each printhead module has only one printhead that has a width that corresponds to a width of the widest media in the cross-process direction that can be printed by the printer. In other embodiments, the printhead modules have a plurality of printheads with each printhead having a width that is less than a width of the widest media in the cross-process direction that the printer can print. In these modules, the printheads are arranged in an array of staggered printheads that enables media wider than a single printhead to be printed. Additionally, the printheads can also be interlaced so the density of the drops ejected by the printheads in the cross-process direction can be greater than the smallest spacing between the inkjets in a printhead in the cross-process direction.

An aqueous ink delivery subsystem 20 has at least one ink reservoir containing one color of aqueous ink. Since the illustrated printer 10 is a multicolor image producing machine, the ink delivery system 20 includes four (4) ink reservoirs, representing four (4) different colors CYMK (cyan, yellow, magenta, black) of aqueous inks. Each ink reservoir is connected to the printhead or printheads in a printhead module to supply ink to the printheads in the module. Pressure sources and vents of the purge system 24 are also operatively connected between the ink reservoirs and the printheads within the printhead modules as known in the art to perform manifold and inkjet purges. Additionally, although not shown in FIG. 1, each printhead in a printhead module is connected to a corresponding waste ink tank with a valve as known in the art to enable purges of printhead manifolds and inkjets. The printhead modules 34A-34D can include associated electronics for operation of the one or more printheads by the controller 80 although those connections are not shown to simplify the figure. Although the printer 10 includes four printhead modules 34A-34D, each of which has two arrays of printheads, alternative configurations include a different number of printhead modules or arrays within a module.

After an ink image is printed on the web W, the image passes under an image dryer 30. The image dryer 30 can include an infrared heater, a heated air blower, air returns, or combinations of these components to heat the ink image and at least partially fix an image to the web. An infrared heater applies infrared heat to the printed image on the surface of the web to evaporate water or solvent in the ink. The heated air blower directs heated air over the ink to supplement the evaporation of the water or solvent from the ink. The air is then collected and evacuated by air returns to reduce the interference of the air flow with other components in the printer.

As further shown, the media web W is unwound from a roll of media 38 as needed by the controller 80 operating one or more actuators 40 to rotate the shaft 42 on which the take up roll 46 is placed to pull the web from the media roll 38 as it rotates with the shaft 36. When the web is completely printed, the take-up roll can be removed from the shaft 42. Alternatively, the printed web can be directed to other processing stations (not shown) that perform tasks such as cutting, collating, binding, and stapling the media.

Operation and control of the various subsystems, components and functions of the machine or printer 10 are performed with the aid of a controller or electronic subsystem (ESS) 80. The ESS or controller 80 is operably connected to the components of the ink delivery system 20, the purge system 24, the printhead modules 34A-34D (and thus the printheads), the actuators 40, and the heater 30. The ESS or controller 80, for example, is a self-contained, dedicated mini-computer having a central processor unit (CPU) with electronic data storage, and a display or user interface (UI) 50. The ESS or controller 80, for example, includes a sensor input and control circuit as well as a pixel placement and control circuit. In addition, the CPU reads, captures, prepares and manages the image data flow between image input sources, such as a scanning system or an online or a work station connection, and the printhead modules 34A-34D. As such, the ESS or controller 80 is the main multi-tasking processor for operating and controlling all of the other machine subsystems and functions, including the printing process.

The controller 80 can be implemented with general or specialized programmable processors that execute programmed instructions. The instructions and data required to perform the programmed functions can be stored in memory associated with the processors or controllers. The processors, their memories, and interface circuitry configure the controllers to perform the operations described below. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in very large scale integrated (VLSI) circuits. Also, the circuits described herein can be implemented with a combination of processors, ASICs, discrete components, or VLSI circuits. As used in this document, the term "a controller configured" to perform one or more functions means the controller is operatively connected to a storage device in which programmed instructions are stored and when the controller executes those instructions, the controller operates components and circuits in the printer to perform the function or functions.

In operation, image data for an image to be produced are sent to the controller 80 from either a scanning system or an online or work station connection for processing and generation of the printhead control signals output to the printhead modules 34A-34D. Additionally, the controller 80 determines and accepts related subsystem and component controls, for example, from operator inputs via the user interface 50, and accordingly executes such controls. As a result, aqueous ink for appropriate colors are delivered to the printhead modules 34A-34D. Additionally, pixel placement control is exercised relative to the surface of the web to form ink images corresponding to the image data, and the media can be wound on the take-up roll or otherwise processed.

To implement a scheme for achieving operation of each inkjet in a printer at the minimum predetermined rate for maintaining its operational status, the minimum predetermined rate must be obtained from the manufacturer and the number of inkjets in the printheads be known to determine the number of ejections that need to occur for each inkjet to be operated at the predetermined minimum rate. For example, if the printheads in a printer having 10,000 inkjets require at least 2.37 ejections/second per inkjet to maintain the operational status of the inkjets, then a total of 23,700 sneeze drop ejections from the 10,000 inkjets per second is required to guarantee the operational status of the inkjets. Of course, some of the inkjets are operated to form ink images but the scheme under current consideration is designed to guarantee that each inkjet in the printheads of the printer is operated enough times to eject sneeze ink drops that each inkjet remains operational without visually degrading the ink images produced during the printing operations.

These 23,700 ejections must be performed over the number of scanlines that pass by the printheads in one second. Thus, in a printer moving the web past the printheads at a rate of 5,000 scanlines per second, 4.74 sneeze drop ejections need to occur per scanline. Since partial ejections are not possible, implementing the necessary number of sneeze drop ejections is not straightforward. Additionally, the sneeze drop ejections that occur in a scanline for a printed image should be well separated from the sneeze drop ejections in the current scanline and well separated from the sneeze drop ejections in previous scanlines to attenuate image degradation that may be caused by the additional ink. Also, every inkjet should be operated to perform one sneeze drop ejection before any inkjet is operated to fire an additional sneeze drop ejection. Assigning each inkjet a number in a sequence that is different than the numbers of the other inkjets in the same sequence enables each inkjet to be operated for a sneeze drop ejection only once in the sequence before the sequence is repeated. Such a sequence results in an equal firing rate for each inkjet and a guaranteed rate of sneeze drop ejection operation for each individual inkjet.

To obtain such an order, the inkjet numbers 1 to N, where N is the number of inkjets in the printer, need to be arranged in a sequence of integers S(x), such that $\min(S(x))=1$; $\max(S(x))=N$, $S(i)\neq S(j)$, $\forall i\neq j$. This sequence, S(x), determines the order in which the inkjets are operated to perform a sneeze drop ejection. For example, in a sequence S(x) in which the first five values of are: 1, 12289, 6145, 10241, 3073, the first inkjet operated to perform a sneeze operation is inkjet 1, followed by inkjet 12289, followed by inkjet 6145, and so on. As noted previously, the sequence should also produce maximum separation between sneeze drops in the same scanline and between sneeze drops in previous scanlines to ensure that human eye detection of sneeze drops in the printed ink images does not occur. That is, not only is the distance between successively numbered inkjets in the sequence maximized, but so is the distance between any pairs of inkjets operated around the same time for sneeze drop ejections. Therefore, for kth order differences for inkjet numbers in a sequence: $\min(|S(i+k)-S(i)|, N-|S(i+k)-S(i)|)$, the differences between successive numbers need to be as large as possible for any difference k. The second term $N-|S(i+k)-S(i)|$ guarantees that the sequence has a good wrap around attribute. That is, the last number in the sequence and the first number in the sequence need to be considered successive so the sequence can be connected to a repetition of the sequence when necessary, which occurs in the process direction embodiment discussed below.

Figure 2:
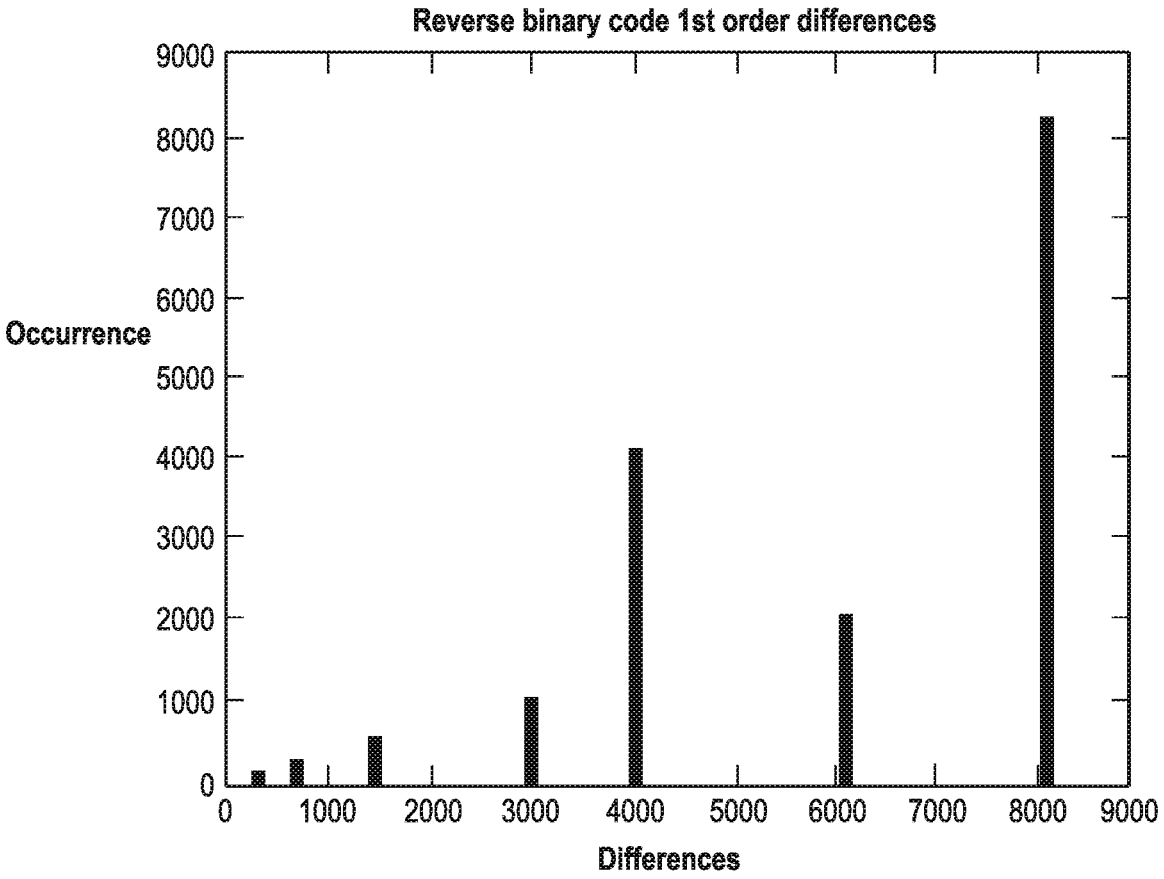
FIG. 2 is a histogram of first order differences in a reverse-bit binary grayscale code.

One way to guarantee large differences between sequential numbers is to configure a counter and reverse the bit order of its output. The reversal toggles the significant digit between successive values, which naturally produces large differences between successive numbers in its output sequence. A graph showing the differences between adjacent numbers in the sequence, S(x), is shown in FIG. 2. As shown in the figure, the differences are typically large, but a significant number of small differences also are produced. Those small differences result in background pixels that are close together and they can be detected in the printed image on a page. By requiring the counter to be a binary counter, the sequence length is a power of two, as counters based on powers of other numbers produce a stitch when the counter is reset to zero.

Figure 3A:
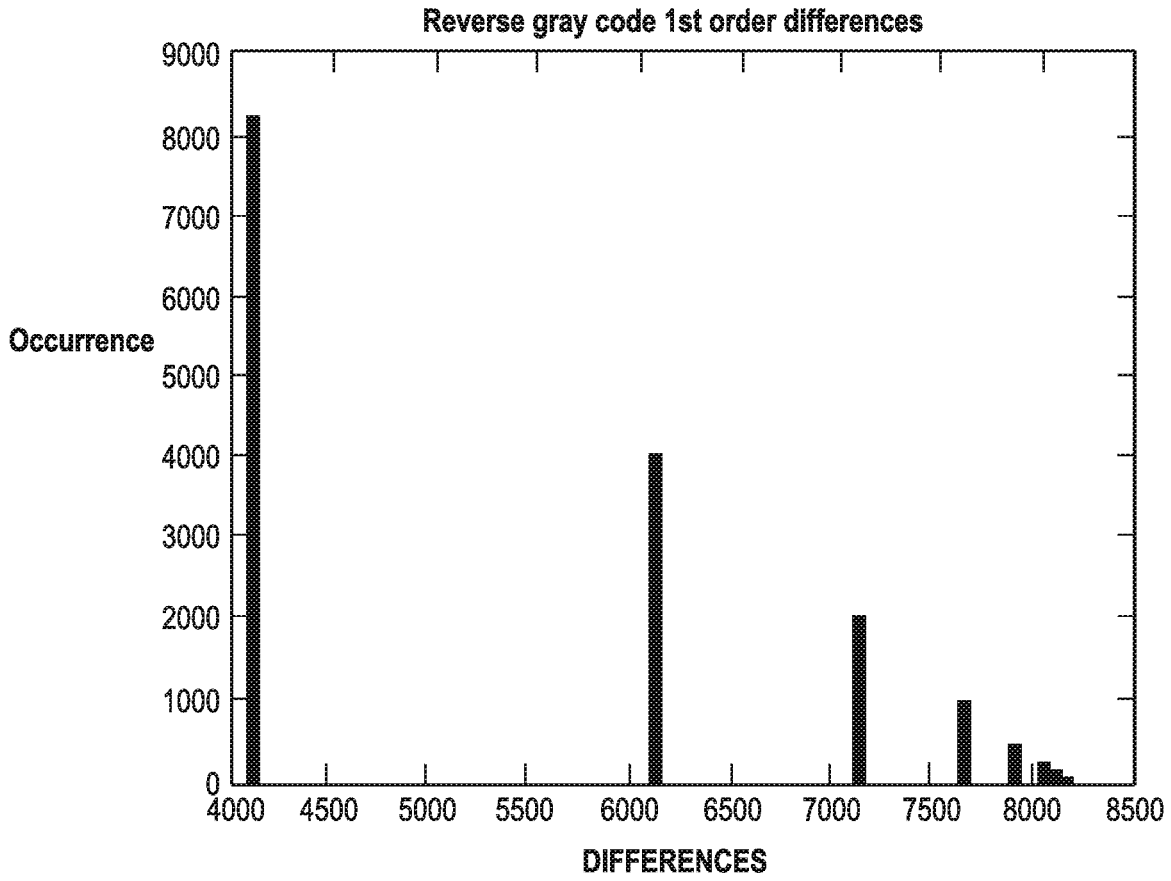
FIG. 3A is a graph that depicts first order differences in a reverse-bit binary grayscale code and FIG. 3B is a graph of second order differences in the reverse-bit binary grayscale code.
Figure 3B:
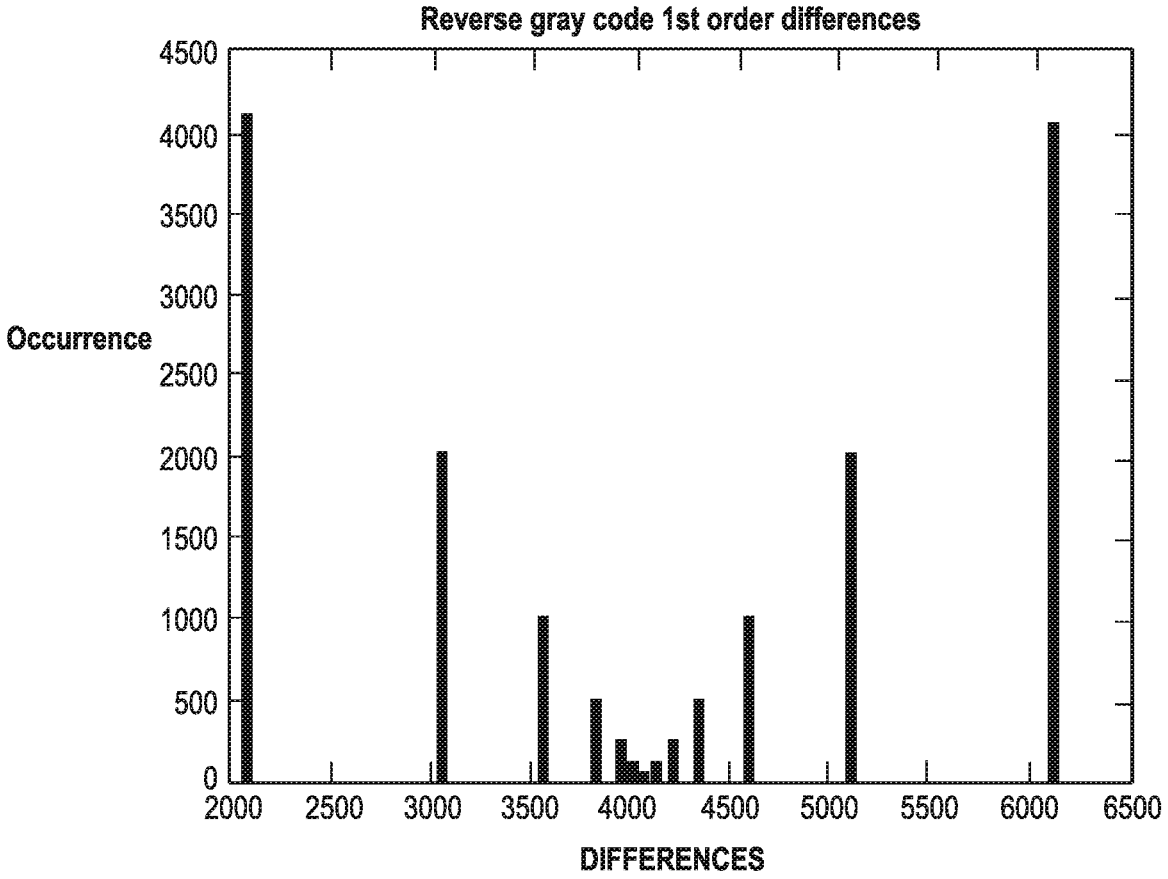

Using a reverse-bit binary grayscale counter removes the small differences in the output of the sequence S(x) shown in FIG. 2. As used in this document, the term "reverse-bit binary grayscale counter" refers to a binary counter that produces a grayscale sequence of code numbers and the bits of every other code number output by the counter is reversed. The grayscale counter output, G(k), can be described as: $G(k)=k\hat{}(k>>1)$. The grayscale counter has the property that between successive entries only one bit changes. By taking every other value from a bit reversed grayscale code counter, then each successive output number has a two bit change—the most significant bit and one other bit. The most significant bit gives a difference between values equal to ½ the number of entries and again only one other bit changes with it. Since the largest difference the other bit change can make is when it is the second most significant bit, the difference between successive values are moved back by one quarter of the numbers in the sequence. Therefore, successive values must have an absolute difference between them of at least one quarter of the length of the sequence. Graphs of the first order and the second order differences of such a reverse-bit binary grayscale sequence are shown in FIG. 3A and FIG. 3B, respectively. Similarly, the differences between sequence values $2^k$ apart can be shown to differ in value by at least $(N/4)/2^k$. That is, $|S(i+2^k)-S(i)|>=(N/4)/2^k$ and this property guarantees good separation between a sequence value and all of its close neighbors.

In the embodiment currently being discussed, the scanlines extend in the cross-process direction across the substrate being printed and the distance between sneeze drops within the scanlines need to be distributed at distances that are sufficient to attenuate image degradation and the sneeze drops in adjacent cross-process direction scanlines need to be placed at such distances as well. As also noted above, the number of drops to be ejected in a scanline may be a fractional number, which cannot be actually printed, especially with a reversed-bit binary grayscale counter since the ejector is either turned on or off. To address this issue, pseudo-scanlines, which extend in the cross-process direction beyond the margins of the printed media, are configured with an appropriate resolution so different numbers of sneeze drops ejected into adjacent scanlines produce an average that approaches the predetermined minimum drop rate.

For example, in one printer, the predetermined minimum rate to maintain operational status of an inkjet requires each inkjet to eject 2.37 drops over 10,000 cross-process direction scanlines that pass by the inkjets in a second to maintain the 10,000 inkjets in the printer. The smallest binary counter that could be used to identify the 10,000 inkjets is one having fourteen bits, which can identify 16,384 inkjets using the numbers 0 through 16,383; however, only the numbers 0-9,999 correspond to an actual inkjet in the printer and only those numbers are used to operate inkjets to eject sneeze drops. To determine the likelihood that the inkjets are operated an appropriate number of times per 10,000 scanlines, the resolution of the scheme needs to be identified. Thus, 2.37 drops/inkjet for 10,000 inkjets is proportional to Z drops/inkjet for 16,384 inkjets so Z is (2.37×16,384)/10,000, which is 3.88 drops per inkjet. Since only whole drops can be ejected, the number of sneeze drops to be ejected per scanline is either three or four. If three inkjets are identified for sneeze drop ejections per scanline, then the resulting number of sneeze drop ejections per inkjet is (3×10,000)/16,384, which is 1.83 drops per inkjet and that fails to meet the required minimum rate of 2.37 ejections per second per inkjet. Operating four inkjets to eject sneeze drops per scanline results in (4×10,000)/16,384, which is 2.44 drops per inkjet and that provides more ejections and ink than is needed to meet the operational minimum.

Since the difference between these two rates appears to result in an inadequate number of ejections per scanline if scanlines are alternated between three sneeze drops and four sneeze drops, a more appropriate distribution may be needed. To achieve a more appropriate distribution, the number of bits in the counter is increased. Continuing the example, using a sixteen-bit binary counter to implement the reverse-bit binary grayscale counter enables each pseudo-scanline in the cross-process direction to identify $2^{16}$ or 65,536 inkjets corresponding to the count zero to 65,535; however, the inkjets numbered from 10,000 to 65,535 don't exist in the printer. Again, the likelihood that the inkjets are operated an appropriate number of times per 10,000 scanlines requires that the resolution of the scheme be identified. Thus, 2.37 drops/inkjet for 10,000 inkjets is proportional to Z drops/inkjet for 65,536 inkjets so Z is (2.37×65,536)/10,000, which is 15.53 drops per inkjet. Since only whole drops can be ejected, the number of sneeze drops to be ejected per scanline is either fifteen or sixteen. If fifteen nozzles are identified for sneeze drop ejection per scanline, then the resulting number of sneeze drop ejections per inkjet is (15×10,000)/65,536, which is 2.29 drops per inkjet and that fails to meet the required minimum rate of 2.37 ejections per second per inkjet but it is closer than 1.83 ejections/inkjet noted above when three inkjets are operated in each scanline using the fourteen-bit counter. Identifying sixteen inkjets to eject sneeze drops per cross-process direction scanline using a sixteen-bit counter results in (16×10,000)/65,536, which is 2.44 drops per inkjet. Although that number of inkjets provides more ejections and ink than is needed, the difference between the two calculations is smaller and more likely to meet the predetermined minimum rate of inkjet operation. If a seventeen-bit counter can be used, the number of inkjets identified for each scanline is either 31 or 32 and the number of drops ejected from each inkjet is between 2.36 and 2.44, which increases the likelihood that each inkjet ejects the predetermined minimum number of drops to maintain operational status so a seventeen-bit counter would be adequate for implementing a sequence that ensures 10,000 inkjets are operated at least 2.37 times per second to produce sneeze drops to ensure the operational status of the inkjets.

The embodiment discussed above does not distinguish between printheads or printhead arrays that print different colors of ink. One way to extend the embodiment discussed above to printers that have printheads that eject different colors of ink is to assign each group of printheads that eject the same color of ink its own reverse-bit grayscale code counter to identify the inkjets to be operated to eject sneeze drops in each scanline. A sequence of the colors is then followed for using the output of the counters to identify the inkjets of each color to eject sneeze drops in a scanline. For example, for a four color printer, a sequence for each of the colors cyan, magenta, yellow, and black is used so the output of the reverse-bit binary grayscale code counters associated with the cyan, magenta, and yellow colors, respectively, are used for identifying the inkjets to fire in a first scanline when three sneeze ink drops are to be placed in the scanline. For the next scanline, the output of the counters associated with the black, cyan, and magenta colors are used for a three drop line or, if four sneeze drops are to be ejected, the output of the counters associated with the black, cyan, magenta, and yellow colors are used. In the configuration having a counter for each color, however, each counter must be initialized with a different starting value so inkjets of different colors close to one another are not operated in the same pseudo-scanline.

If all of the inkjets in all of the printheads for the different colors are identified with a single reverse-bit grayscale counter, however, the need for different initial values for the various counters is removed. In this configuration, the inkjets for the printheads of different colors are identified with a contiguous number range and the reverse-bit binary grayscale counter is at least $\log_2 N-1$ bits long, where N is the total number of inkjets in the printheads ejecting the different colors. In this configuration, only an odd number of colors can be included in the group of inkjets identified by this counter. For example, if a group of printheads ejects magenta, cyan, and black inks, then the first number from the counter used for inkjet identification identifies a magenta ejecting inkjet, the second number from the counter used for inkjet identification identifies a cyan ejecting inkjet, and the third number from the counter used for inkjet identification identifies a black inkjet and then the cycle repeats. If a fourth color is ejected by one or more of the other printheads in the printer, such as yellow ink, for instance, then another reverse-bit binary grayscale counter is needed for that color and it must be initialized to start at a value different than the value at which the reverse-bit binary grayscale counter for the other three colors is initialized. The problem with using a reverse-bit binary grayscale counter for an even number of colors is that one of the colors is always printed at a same position in each pseudo-scanline and, thus, becomes detectable by the human eye. Consequently, for any printer that ejects an even number N of colors, one reverse-bit binary grayscale counter is used to identify inkjets for sneeze drop ejections in a pseudo scanline for (N−1) colors and another reverse-bit binary grayscale counter is used for the remaining color, although other combinations can be used provided no group of colors associated with a reverse-bit binary grayscale counter can contain an even number of colors.

Figure 4:
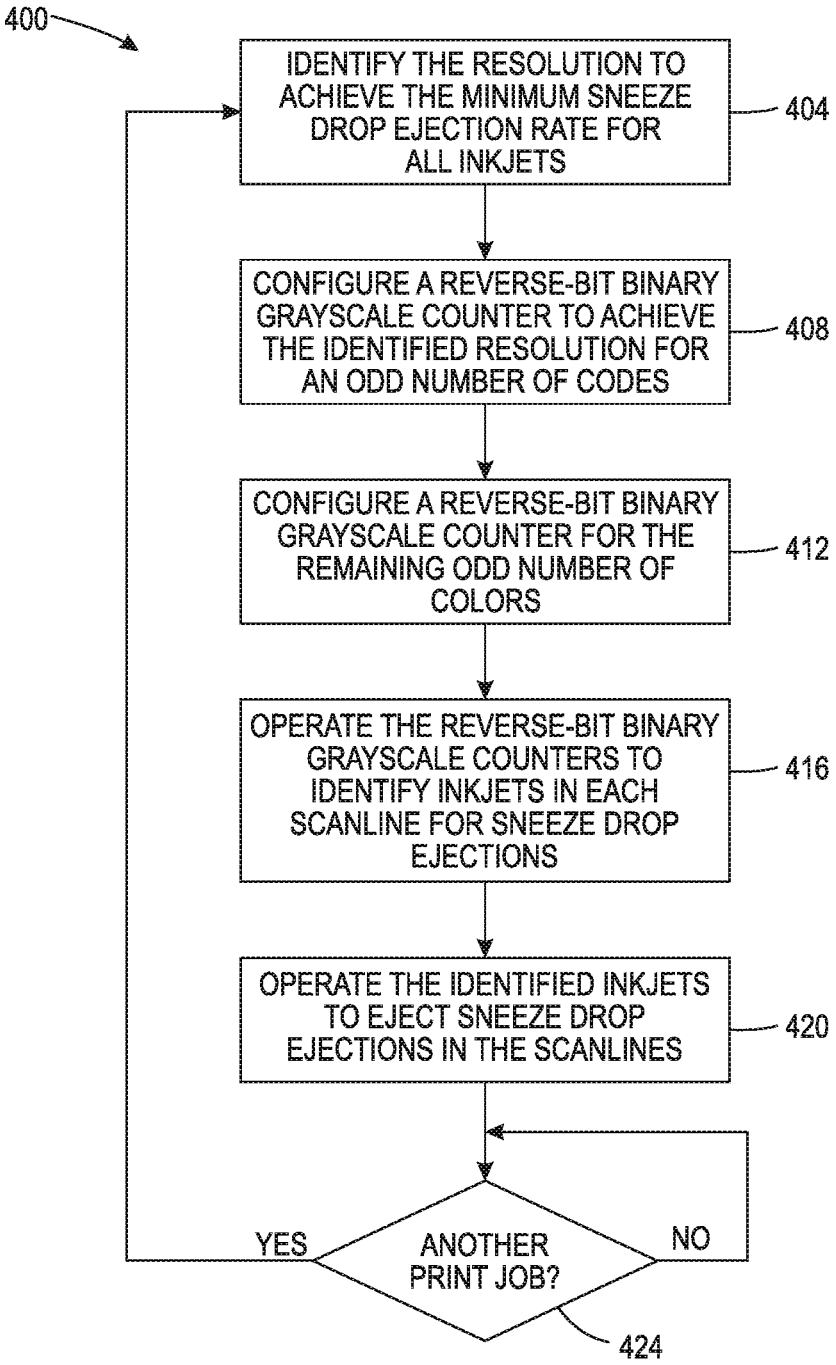
FIG. 4 is a flow diagram of a process used by the controller of the inkjet printer of FIG. 1 to achieve predetermined minimum rates of inkjet operation in cross-process direction pseudo-scanlines without visibly degrading the image quality of the printed ink images.

A process 400 for identifying inkjets in a printer to eject sneeze drops in each cross-process direction scanline is shown in FIG. 4. In the description of the process, statements that the process is performing some task or function refers to a controller or general purpose processor executing programmed instructions stored in non-transitory computer readable storage media operatively connected to the controller or processor to manipulate data or to operate one or more components in the printer to perform the task or function. The controller 80 noted above can be such a controller or processor. Alternatively, the controller can be implemented with more than one processor and associated circuitry and components, each of which is configured to form one or more tasks or functions described herein. Additionally, the steps of the method may be performed in any feasible chronological order, regardless of the order shown in the figures or the order in which the processing is described.

The process 400 begins with an identification of the resolution required to achieve the minimum sneeze drop ejection rate to maintain inkjet operational status (block 404). This identification is used to configure a reverse-bit binary grayscale counter of an appropriate length to achieve the requisite resolution for an odd number of colors (block 408). Also, a reverse-bit binary grayscale counter of the appropriate length is configured to achieve the requisite resolution for the remaining odd number of colors (block 412). The counters are initialized and the sequence numbers from the counters are used to identify the inkjets in each scanline that are operated to eject sneeze drops to ensure operational status of the inkjets as described previously (block 416). The identified inkjets are operated by the controller to eject sneeze drops in each scanline in a print job (block 420). At the end of a print job, the process terminates until another print job is sent to the controller (block 424).

In the discussion above, the pseudo-scanlines have been discussed as extending in the cross-process direction beyond the edge of the substrate being printed and the inkjets to be operated in each pseudo-scanline to produce sneeze drops are identified by a sequence produced by the reverse-bit grayscale counter. In an alternative embodiment, scanlines are viewed as extending in the process direction so they form pseudo-pages that extend beyond the edge of a page to be printed in the process direction. Again, the distance between sneeze drops in the process direction pseudo-pages need to be distributed at distances that are sufficiently large that the sneeze drops are spread over the ink image so they are not detectable by the human eye and the sneeze drops at adjacent page boundaries also need to be placed at these appropriate distances. As also noted above, the number of drops to be ejected in a pseudo-page may be a fractional number theoretically but fractional ink drops are not physically possible. To address this issue in the process direction embodiment, the pseudo-pages, which extend in the process direction, are configured with an appropriate resolution so different numbers of sneeze drops in the adjacent scanlines extending in the process direction produce an average that approaches the predetermined minimum drop rate.

In the embodiment using pseudo-pages, the sequence output of the reverse-bit binary grayscale counter is used to identify the scanlines in which an inkjet is operated to eject sneeze drops rather than identifying the inkjets to operate as is the case in the embodiment using the cross-process direction pseudo-scanlines. The required resolution for achieving the minimum sneeze drop ejection rate for all of the inkjets is identified to establish the number of bits for the reverse-bit binary grayscale counter. Evaluating the resolution required for a printer having 10,000 inkjets that need 2.37 ejections per second to maintain operational status indicates that 3.88 or four sneeze drop ejections are required per inkjet over 65,536 scanlines to achieve the desired rate that maintains the operational status for the 10,000 inkjets. Thus, a sixteen-bit counter is configured for this scenario. The scanline length of the actual pages printed are then taken into account over the 65,536 scanline pseudo-page. In this example, an actual page length in the process direction is 20,000 lines. Starting with the first inkjet, the first four sequence outputs of the reverse-bit binary grayscale counter are used to identify the scanlines in the first printed page where the first inkjet is operated to eject a sneeze drop. Since the numbers output by the reverse-bit binary grayscale counter can be from 0 to 65,535, those numbers equal to or greater than 20,000 are ignored since the first page only has scanlines 0 to 19,999. This process continues for each inkjet until the last inkjet in the 10,000 inkjets is assigned four sequence code numbers in the range of 0 to 19,999 to identify the scanlines in the first page where an inkjet ejects a sneeze drop. The reverse-bit binary grayscale counter rolls over so each inkjet in the 10,000 inkjets can be assigned four scanlines in the zero to 19,999 range.

After the scanlines in the first page are identified for each inkjet to eject sneeze drops, the reverse-bit binary grayscale counter is reset and the process is repeated for the next page to be printed. Again, the process begins with the first inkjet and continues to the last inkjet but the four numbers that identify the scanlines in the second page for an inkjet must be within the range of 20,000 to 39,999. Numbers generated by the reverse-bit binary grayscale counter that are outside that range are not used to identify scanlines for the inkjets. This process is repeated for the third page to be printed after the reverse-bit binary grayscale counter is reset but now only sequence numbers in the range of 40,000 to 59,999 are used to identify scanlines in the third page where inkjets eject sneeze drops. For the next page, the reversed bit binary grayscale counter is reset but the 20,000 scanlines in the fourth page are identified by the sequence output numbers 60,000 to 65,535 and zero to 14,463. Any sequence numbers outside of this range are not used to identify scanlines for inkjets to eject sneeze drops. After the counter is reset for scanline assignment in the fifth page, the 20,000 scanlines are identified by the sequence numbers in the range of 14,464 to 34,463. The process continues for each subsequent page in a print job until the print job is completed and then the reverse-bit binary grayscale counter is reset for the next print job and the scanline assignment process is reinitialized.

Figure 5:
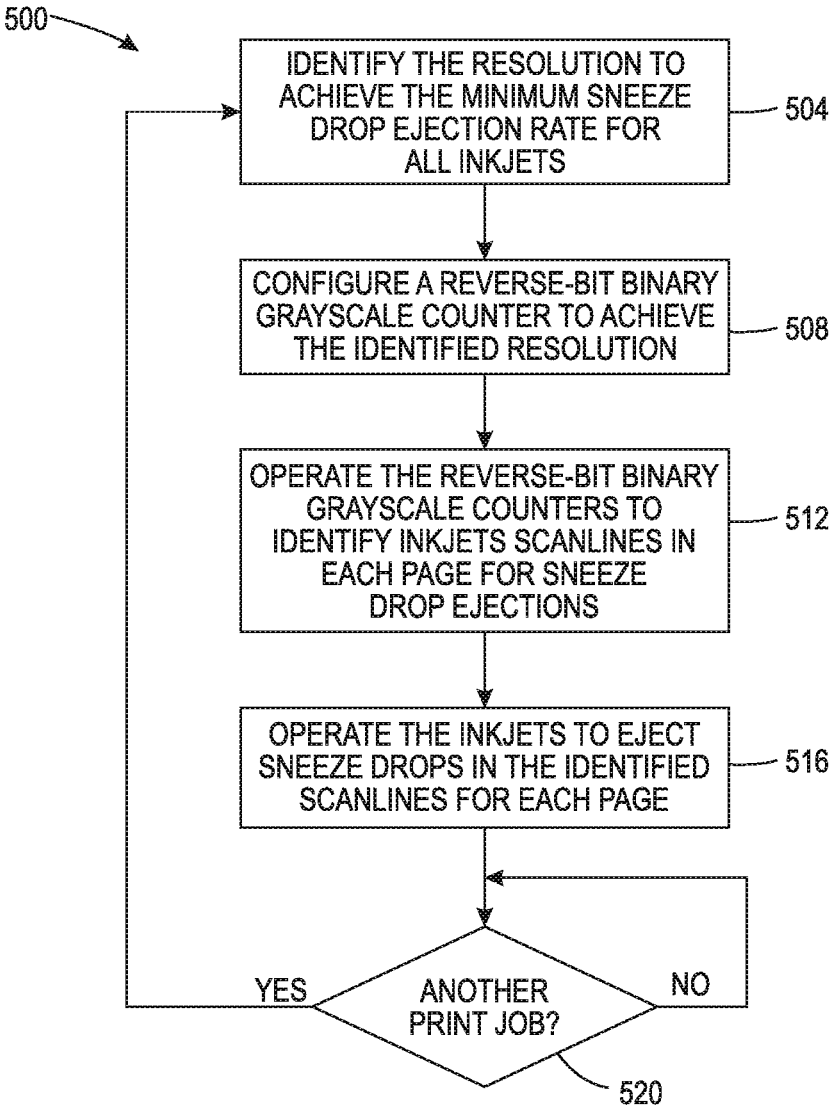
FIG. 5 is a flow diagram of a process used by the controller of the inkjet printer of FIG. 1 to achieve predetermined minimum rates of inkjet operation in process direction pseudo-pages without visibly degrading the image quality of the printed ink images.

FIG. 5 is a flow diagram of a process 500 used by the controller of the inkjet printer of FIG. 1 to achieve predetermined minimum rates of inkjet operation in process direction pseudo-pages without visibly degrading the image quality of the printed ink images. The process begins with an identification of the resolution required to achieve the minimum sneeze drop ejection rate to maintain inkjet operational status (block 504). This identification is used to configure a reverse-bit binary grayscale counter of an appropriate length to achieve the requisite resolution (block 508). The counter is initialized and the sequence numbers are used to identify the scanlines in which each inkjet ejects sneeze drops to ensure operational status of the inkjets as described previously (block 512). The identified scanlines are used by the controller to operate the inkjets to eject sneeze drops in their identified scanlines for each printed page in a print job (block 516). At the end of a print job, the process terminates until another print job is sent to the controller (block 520).

The embodiment that identifies scanlines for inkjets discussed above does not need to distinguish between printheads or printhead arrays that print different colors of ink because the numbers output by the counters are used to identify scanlines and not inkjets. Thus, the process is indiscriminate with regard to the color of ink ejected by the inkjets so the requirement that a counter be assigned to only an odd number of colors is removed.

It will be appreciated that variants of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed:

1. A method of identifying inkjets to operate in each scanline to eject sneeze drops comprising:

operating with a controller a binary grayscale code counter to generate a sequence of binary grayscale code numbers, the sequence having a number of binary grayscale code numbers equal to or greater than a number of inkjets in the printer and each binary grayscale code number in the sequence having a number of bits equal to or greater than $\log_2 (N-1)$, where N is a number of inkjets in the printer; and operating with the controller a predetermined number of inkjets for each scanline extending in a cross-process direction to eject sneeze drops in each scanline, the inkjets operated in each scanline being identified using a number of binary grayscale code numbers produced in the sequence of the binary grayscale code numbers that correspond to the predetermined number of inkjets and all of the inkjets in the printer are operated once to eject sneeze drops during a single sequence produced by the binary grayscale code counter.

2. The method of claim 1 further comprising:

identifying the predetermined number of inkjets to operate in each scanline using a predetermined minimum number of times an inkjet is required to be operated per predetermined unit of time to maintain the operational status of the inkjet, the number of inkjets in the printer, and a number of scanlines per the predetermined unit of time that pass by the inkjets in the printer.

3. The method of claim 2 further comprising:

reversing the bits of every other code number in the sequence of binary grayscale code numbers before using every other code number in the sequence to identify an inkjet to be operated to eject a sneeze drop in one of the scanlines.

4. The method of claim 3 wherein the number of binary grayscale code numbers in the sequence is greater than the number of inkjets in the printer but only those binary grayscale code numbers in a range of zero to N−1 are used to identify inkjets to be operated to eject sneeze drops in each scanline.

5. The method of claim 4 further comprising:

identifying a number of sneeze drop ejections per inkjet for the binary grayscale code counter that generates binary grayscale code numbers having a smallest number of bits sufficient to generate a binary grayscale code number for each inkjet;

comparing the identified number of sneeze drop ejections per inkjet to the predetermined minimum number of times an inkjet is required to be operated per predetermined unit of time to maintain the operational status of the inkjet; and increasing a number of bits for each binary grayscale code number produced by the binary grayscale code counter when the identified number of sneeze drop ejections per inkjet is less than the predetermined minimum number of times an inkjet is required to be operated per predetermined unit of time to maintain the operational status of the inkjet.

6. The method of claim 5 further comprising:

identifying a number of sneeze drop ejections per inkjet for the binary grayscale code counter that generates binary grayscale code numbers having the increased number of bits;

comparing the identified number of sneeze drop ejections per inkjet to the predetermined minimum number of times an inkjet is required to be operated per predetermined unit of time to maintain the operational status of the inkjet; and increasing the number of bits for each binary grayscale code number produced by the binary grayscale code counter above the previously identified increased number of bits when the identified number of sneeze drop ejections per inkjet corresponding to the previously identified increased number of bits is less than the predetermined minimum number of times an inkjet is required to be operated per predetermined unit of time to maintain the operational status of the inkjet.

7. The method of claim 6 wherein the printer ejects Y colors of ink where Y is an odd number and the method further comprising:

using each binary grayscale number in a sequence of Y binary grayscale code numbers from the sequence of binary grayscale code numbers produced by the binary grayscale code counter to identify only one inkjet that ejects a color of ink different than the colors of ink ejected by the other inkjets identified by the Y binary grayscale code numbers.

8. The method of claim 6 wherein the printer ejects Y colors of ink where Y is an even number and the method further comprising:

using each binary grayscale number in a sequence of Y−1 binary grayscale code numbers from the sequence of binary grayscale code numbers produced by the binary grayscale code counter to identify and operate only one inkjet that ejects a color of ink different than the colors of ink ejected by the other inkjets identified by the Y−1 binary grayscale code numbers;

operating with the controller another binary grayscale code counter to generate a sequence of binary grayscale code numbers that are used to identify inkjets that eject the color of ink not ejected by the inkjets identified with the Y−1 binary grayscale code numbers, the sequence having a number of binary grayscale code numbers equal to or greater than the number of inkjets in the printer that eject the color of ink not ejected by the inkjets identified with the Y−1 binary grayscale code numbers and each binary grayscale code number in the sequence produced by the other binary grayscale code counter has a number of bits equal to or greater than $\log_2 (N-1)$, where N is a number of inkjets in the printer that eject the color of ink not ejected by the inkjets identified with the Y−1 binary grayscale code numbers; and operating with the controller a predetermined number of inkjets that are identified with binary grayscale code numbers produced by the other binary grayscale code counter to eject sneeze drops in each scanline.

9. The method of claim 1 further comprising:

initializing with the controller a binary grayscale code counter for each color of ink ejected by the inkjets in the printer, each binary grayscale code counter being initialized with a different number;

operating each binary grayscale code counter to generate a sequence of binary grayscale code numbers for each color of ink, the sequence having a number of binary grayscale code numbers equal to or greater than the number of inkjets in the printer that eject the color of ink associated with the binary grayscale code counter and each binary grayscale code number in the sequence having a number of bits equal to or greater than $\log_2(N-1)$, where N is a number of inkjets in the printer that eject the color of ink associated with the binary grayscale code counter; and using the sequence produced by each binary grayscale code counter to identify and operate the inkjets ejecting the color of ink associated with the binary grayscale code counter for the predetermined number of inkjets in each scanline extending in the cross-process direction to eject sneeze drops of each color in each scanline.

10. The method of claim 9 further comprising:

identifying the predetermined number of inkjets to operate in each scanline for each color of ink using a predetermined minimum number of times an inkjet is required to be operated per predetermined unit of time to maintain the operational status of the inkjet, the number of inkjets in the printer that eject the color of ink associated with each binary grayscale code counter, and a number of scanlines per the predetermined unit of time that pass by the inkjets in the printer.

11. The method of claim 10 further comprising:

reversing the bits of every other code number in the sequence of binary grayscale code numbers produced by each binary grayscale code counter before using every other code number in the sequence to identify an inkjet to be operated to eject a sneeze drop of the color of ink associated with the binary grayscale code counter in one of the scanlines.

12. A method of identifying inkjets to operate in each scanline to eject sneeze drops comprising:

operating with a controller a binary grayscale code counter to generate a sequence of binary grayscale code numbers, the sequence having a number of binary grayscale code numbers equal to or greater than a number of cross-process direction scanlines that extend in a process direction to form a page printed by a printer and each binary grayscale code number in the sequence having a number of bits equal to or greater than $\log_2(N-1)$, where N is the number of binary grayscale code numbers generated by the binary grayscale code counter;

identifying the cross-process direction scanlines within the page where each inkjet in printer ejects a sneeze, the cross-process direction scanline identifications being made using the binary grayscale code numbers generated by the binary grayscale code counter; and operating with the controller each inkjet at the identified cross-process direction scanlines within the page for each inkjet to eject sneeze drops.

13. The method of claim 12 further comprising:

identifying the cross-process direction scanlines within the page at which to operate each inkjet using a predetermined minimum number of times an inkjet is required to be operated per predetermined unit of time to maintain an operational status of the inkjet, the number of cross-process directions scanlines in the page to be printed by the printer, and a number of cross-process direction scanlines per the predetermined unit of time that pass by the inkjets in the printer.

14. The method of claim 13 further comprising:

reversing the bits of every other code number in the sequence of binary grayscale code numbers before using every other code number in the sequence to identify a cross-process direction scanline in which an inkjet is to be operated to eject a sneeze drop.

15. The method of claim 14 wherein only those binary grayscale code numbers in a range from zero to the number of cross-process direction scanlines in the page printed by the printer minus one are used to identify the cross-process direction scanlines in the page at which the inkjets are to be operated to eject sneeze drops.

16. The method of claim 15 further comprising:

resetting the binary grayscale code counter after the cross-process direction scanlines in a first page having the number of cross-process direction scanlines for the page printed by the printer have been identified for each inkjet in the printer; and using only those binary grayscale code numbers in a range from the number of cross-process direction scanlines in the page printed by the printer to twice the number of cross-process direction scanlines minus one to identify cross-process direction scanlines in a second page at which inkjets are to be operated to eject sneeze drops.

17. The method of claim 16 further comprising:

resetting the binary grayscale code counter after the cross-process direction scanlines in the second page having the number of cross-process direction scanlines have been identified for each inkjet in the printer; and using those binary grayscale code numbers in a range from the twice the predetermined number of cross-process direction scanlines in the page printed by the printer to N−1 are used to identify cross-process direction scanlines in a third page at which inkjets are to be operated to eject sneeze drops and those binary grayscale code numbers in a range from zero to the number of cross-process direction scanlines in the page printed by the printer less a number of cross-process direction scanlines in the range from the twice the number of cross-process direction scanlines in the page printed by the printer to N−1 are used to identify scanlines in the third page at which inkjets are to be operated to eject sneeze drops.

18. The method of claim 15 further comprising:

identifying a number of sneeze drop ejections per inkjet for the binary grayscale code counter that generates binary grayscale code numbers having a smallest number of bits sufficient to generate a binary grayscale code number for each cross-process direction scanline in the N cross-process direction scanlines;

comparing the identified number of sneeze drop ejections per inkjet to a predetermined minimum number of times an inkjet is required to be operated per predetermined unit of time to maintain an operational status of the inkjet; and increasing a number of bits for each binary grayscale code number produced by the binary grayscale code counter when the identified number of sneeze drop ejections per inkjet is less than the predetermined minimum number of times an inkjet is required to be operated per predetermined unit of time to maintain the operational status of the inkjet.

19. The method of claim 18 further comprising:

identifying a number of sneeze drop ejections per inkjet for the binary grayscale code counter that generates binary grayscale code numbers having the increased number of bits;

comparing the identified number of sneeze drop ejections per inkjet to the predetermined minimum number of times an inkjet is required to be operated per predetermined unit of time to maintain the operational status of the inkjet; and increasing the number of bits for each binary grayscale code number produced by the binary grayscale code counter above the previously identified increased number of bits when the identified number of sneeze drop ejections per inkjet corresponding to the previously identified increased number of bits is less than the predetermined minimum number of times an inkjet is required to be operated per predetermined unit of time to maintain the operational status of the inkjet.

* * * * *